US008466385B1

(12) United States Patent
Glaser

(10) Patent No.: US 8,466,385 B1
(45) Date of Patent: Jun. 18, 2013

(54) TOROIDAL VACUUM INTERRUPTER FOR MODULAR MULTI-BREAK SWITCHGEAR

(76) Inventor: Michael David Glaser, Brookfield, WI (US)

( * ) Notice: Subject to any disclaimer, the term of this patent is extended or adjusted under 35 U.S.C. 154(b) by 342 days.

(21) Appl. No.: 13/081,665

(22) Filed: Apr. 7, 2011

(51) Int. Cl.
*H01H 33/66* (2006.01)

(52) U.S. Cl.
USPC ..... 218/144; 218/140

(58) Field of Classification Search
USPC ..... 218/118–121, 140–145, 153–155
See application file for complete search history.

(56) References Cited

U.S. PATENT DOCUMENTS

| | | | | |
|---|---|---|---|---|
| 2,859,309 | A | 11/1958 | Schwager et al. | |
| 2,863,026 | A | 12/1958 | Jennings | |
| 3,250,880 | A | 5/1966 | Jennings | |
| 3,283,101 | A | 11/1966 | Combine et al. | |
| 3,405,245 | A | 10/1968 | Ito et al. | |
| 3,534,226 | A * | 10/1970 | Lian | 218/144 |
| 3,792,213 | A | 2/1974 | Kane et al. | |
| 3,813,506 | A | 5/1974 | Mitchell | |
| 3,839,612 | A | 10/1974 | Badey et al. | |
| 4,027,123 | A | 5/1977 | Ihara | |
| 4,107,496 | A | 8/1978 | Clason | |
| 4,246,458 | A | 1/1981 | Yanabu et al. | |
| 4,871,888 | A | 10/1989 | Bestel | |
| 4,972,055 | A | 11/1990 | Perulfi et al. | |
| 5,698,831 | A * | 12/1997 | Abdelgawad et al. | 218/138 |
| 6,242,708 | B1 | 6/2001 | Marchand et al. | |
| 6,476,338 | B2 | 11/2002 | Shioiri et al. | |
| 6,498,315 | B1 | 12/2002 | Betz et al. | |
| 6,867,385 | B2 | 3/2005 | Stoving et al. | |
| 7,053,327 | B2 * | 5/2006 | Benke et al. | 218/140 |
| 7,239,492 | B2 | 7/2007 | Heimbach et al. | |
| 2006/0016787 | A1 | 1/2006 | Stoving et al. | |

* cited by examiner

*Primary Examiner* — Amy Cohen Johnson
*Assistant Examiner* — Marina Fishman
(74) *Attorney, Agent, or Firm* — Donald J. Ersler

(57) ABSTRACT

A toroidal vacuum switch/interrupter for modular switchgear is disclosed. The toroidal vacuum module includes a coaxial moving contact drive rod system, which includes a nonconductive tube inside of a moving insulating cylinder. A contact drive rod system drives a contact system. The contact configuration allows the center contact rod to extend completely through the vacuum envelope to drive successive series connected modules. A system of capacitors and resistors is provided in the insulated portion of the contact drive rod, which extends through the module to connect to and balance the voltage between any series connected vacuum modules. A mechanical adjustment system provides contact pressure and a means to adjust out tolerance build-up within the vacuum module to provide the contacts with a uniform set point. This allows multiple vacuum modules to be connected together in series combinations and provides for simultaneous operation of the contacts in each module.

19 Claims, 13 Drawing Sheets

TOROIDAL VACUUM INTERRUPTER FOR MODULAR MULTI-BREAK SWITCHGEAR

BACKGROUND OF THE INVENTION

1. Field of the Invention

The present invention relates generally to the field of high voltage vacuum switches and circuit interrupting devices and more particularly to a toroidal vacuum interrupter for modular multi-break switchgear.

2. Discussion of the Prior Art

Single vacuum interrupters utilized in high power switchgear have generally been limited to the voltage range below 46 kV. In modern vacuum switchgear, multiple vacuum contact breaks have been employed to provide higher voltage ratings.

A number of vacuum prior art arrangements are directed to provide a vacuum interrupter with two or more contacts within the same envelope as illustrated in U.S. Pat. Nos. 3,250,880; 3,405,245; 4,107,496; 4,246,458 and 6,476,338 B2. The first three cited patents present devices in which two moving contact structures must be moved in opposite directs to achieve two series contact breaks, necessitating a complex and costly operating mechanism. The latter two patents represent devices that rely on the transfer of the electric arc to one or more sets of auxiliary contacts as the moving contact is drawn past them. This can result in longer arcing times as the moving contact is drawn through its stroke to establish the multiple breaks as well as severe erosion along the edges of the contacts at the arc transfer points.

A more common practice for creating switchgear with two or more contact breaks in series is to simply mount the required number of single break vacuum interrupters in series as shown by U.S. Pat. Nos. 2,859,309; 3,792,213; 3,813,506; 3,839,612; 4,027,123; 4,972,055; 6,242,708; 6,498,315 B1; 7,239,492 B2. This practice requires the use of complex and costly interconnecting mechanisms for the series interrupter modules and results in a bulky switchgear unit.

Another prior art interrupter utilizes multiple contact systems where one set of contacts drives another as illustrated in U.S. Pat. No. 2,863,026. In this case, the operating spring for the driven contact is mounted inside the interrupter and is subject to annealing during the brazing together of the interrupter. While work hardening will result in the return of some of the spring force characteristics, its final force characteristics will be uncontrolled. Additionally, no means is provided to precisely position the driven contact, adjust out the tolerance accumulation between the multiple parts or to balance the voltage between the two contact gaps.

U.S. Pat. No. 3,283,101 and Patent application publication no. US 2007/0262054 A1 disclose a double break vacuum interrupter, which is operated by a single moving contact rod. The first cited patent shows an extremely complex method of assuring that the contacts make and break at the same time and does not indicate the use of capacitance to balance the voltages between the two contact gaps. With the cited patent application, there is no indication of how tolerance accumulation of the components and contact wear are accounted for to assure that both contact breaks can continue to make over the life of the device. In addition, the fact that the contact structures are mounted in a parallel configuration results in a bulky vacuum module.

Patent application publication no.: US 2010/0108643 A1 also discloses a double break vacuum interrupter, which is operated by a single contact rod. This device contains an internally mounted bellows like spring, which would become annealed during the interrupter brazing cycle and would greatly affect its force characteristics. The spring would regain some of its spring force with work hardening; however, its final force characteristics would be uncontrolled. When the contacts close, the contact rod drives one moving contact into the second moving contact and then the second contact into the stationary contact which provides for making only one set of contacts instead of two, which can result in a longer pre-strike and possible welding. In addition, there is a further possibility of contact welding as the contact rod only drives one contact open, with the internal spring returning the other contact to the open position.

While the aforementioned prior art arrangements may be suitable for their intended use in accordance with their respective defined applications, as discussed hereinbefore, it would be desirable to provide a system of vacuum switch or interrupter modules that may be connected in series and driven by a single contact rod to allow for the fabrication of various forms of high voltage switchgear at different voltage ratings

SUMMARY OF THE INVENTION

Accordingly, it is the principal object of the present invention to provide a modular system of vacuum switch and interrupter modules connected in series and driven by a single contact rod to allow for the fabrication of various forms of high voltage vacuum switchgear at different voltage ratings.

In the practice of the invention, the vacuum module has an annular moving contact which engages an annular stationary contact. Both of the contacts are preferably fabricated from copper-tungsten material, if the interrupter is designed for switching duty or chromium-copper, if the interrupter is designed to interrupt fault currents. The outside diameter of the moving contact is connected by a bellows to an end cup supported by a tubular insulator, which is preferably made of ceramic and forms the main portion of the interrupter housing. The bellows is preferably fabricated from stainless steel and the end cup from monel. The inside diameter of the moving contact is connected by a second bellows to a drive plate, which is attached by an internal end-cup to an internal moving tubular insulator which is preferably made of ceramic. The second bellows is preferably fabricated from stainless steel and the internal end cup is preferably fabricated from monel or stainless steel. An annular shield is preferably fabricated from stainless steel and is also connected to the drive plate to protect the outer diameter of the internal moving tubular insulator from metallic vapor deposits generated by the arcing of the contacts. The annular shield connected to the inside diameter of the insulator housing provides the same function. The bellows is flexible and is used to allow motion of the annular floating contact and allow for sealing of the end-cup. The bellows shields are provided to prevent the bellows from being damaged by the metallic vapors produced by arcing. The other end of the insulator housing is connected to an end cup preferably fabricated from stainless steel or monel, which supports the outside diameter of the annular stationary contact. The inside diameter of the annular stationary contact connects to an end plate preferably fabricated from stainless steel or monel. The end plate is also connected to a third bellows, which in turn is connected to the other end of the internal moving tubular insulator. The third bellows seals the vacuum envelope and allows motion of the tubular insulator and internal drive rod described below. The vacuum interrupter configured as described above forms a toroid with one end of the center hole closed off with the drive plate. The drive plate has a hole through the center to facilitate the connection of two drive rods. Both drive rods are installed and connected together after the vacuum envelope is brazed together. The first contact drive rod is used to connect to the external drive mechanism for the modular switchgear and to provide a means to drive and position the annular moving contact as well as provide contact pressure. The second drive rod includes a tube preferably fabricated from an epoxy glass into which is inserted a system of capacitors and resistors that form a capacitive voltage divider to balance the voltage between the contacts of successively connected vacuum modules so as to provide more efficient interruption of the electric current. The second drive rod is positioned along the axis of the module and is coaxial with respect to the internal insulator and all internal contact structures. Epoxy is preferably used to fill the gap between each contact drive rod and the inner diameter of the internal ceramic for improved dielectric performance. The second drive rod extends out the top of the vacuum module to provide a connection and drive means for any connected vacuum modules.

An annular housing is mounted on the end cup that supports the annular moving contact, which provides for a bellows anti-twist means and a guide for an adjustment mechanism. The adjustment mechanism is mounted on the first drive rod. The adjustment mechanism allows the tolerance accumulation of the components to be adjusted out and for the contacts positioned in a standard location for each module. The adjustment mechanism also supplies a source of contact pressure to the contacts.

The adjustment mechanism includes the annular housing, which has two long slots along the main axis placed 180 degrees apart. The length of the two long slots is the sum of the diameter of the holes in an adjuster described below plus the full range of tolerance accumulation of all parts that determine the spacing between the contacts in the open position. This allows the adjustment mechanism to have the capability of adjusting out the tolerance build-up in the system. The annular moving contact support has a cross-hole placed, so that it would lie approximately at the center of the length of the slot in the housing. A fixture pin placed in the through hole in the annular moving contact support, so that it passes through both slots cut into the housing. In this manner, when the interrupter is processed through a brazing cycle, the relationship between the annular moving contact support and housing is established and the housing can also be used as a bellows anti-twist device. After the interrupter is brazed, the fixture pin is removed. The contact rod is installed so that a stud on its end passes through the hole in the drive plate and the slot in the contact rod aligns with the hole in the moving contact support and slot in the housing. The fixture pin is then reinstalled and the capacitive voltage divider contact rod is then threaded onto the contact rod. Epoxy insulation is then preferably provided around the portion of this capacitive voltage divider drive rod in the area of the inner diameter of the internal insulator. The fixture pin is removed and the adjuster is then threaded onto the contact rod. The adjuster has six slots spaced 60 degrees apart, parallel to the main axis and of a length that is calculated to provide the desired compression of a spring to provide the needed contact pressure plus a small amount of over travel. If the module is to be applied in a pre-insertion application as described below, the length of the slot should be the design travel distance of the pre-insertion contact plus the distance required for the contact pressure described above. The adjuster also has a counter-bore into which a compression spring or series of Bellville washers may be inserted. With the contacts fixtured in the full open position, the adjuster is rotated so that the radius at the end of the slot closest to the vacuum module is aligned with the cross-hole in the moving contact support. The multiple slots in the adjuster allow for a finer adjustment in determining this setting. Once the adjustment is complete, the pin is inserted, so that it passes through the housing, moving contact support, adjuster and the adapter for the contact rod.

The pin is secured with washers and retaining rings at both ends. The spring is then inserted into the counter bore of the adjuster and secured with the spring retainer cap. This forces the pin through the moving contact support to the portion of the adjuster slots closest to the module to provide a standardized position of the moving contact with respect to the operating rod. If the module is to be used in a pre-insertion application, the adjustment is performed with the contacts held in the closed position and the adjuster is rotated so the radius at the end of the slot furthest from the module aligns with the cross hole in the moving contact support.

The portion of the voltage divider drive rod that extends through the top of the vacuum envelope is terminated with threads to allow connection to another series mounted vacuum module. A turnbuckle adapter is provided to join the modules together. The two modules are threaded together to the point that two "C" brackets fit snug between the facing shoulders of studs mounted on either end cup of the vacuum envelope. During this portion of assembly, the turnbuckle is adjusted in a way to increase or decrease its length without altering the position of the moving contact in either module being joined. In this manner, the individual module contact adjustments are preserved so that all join contacts operate simultaneously. Nuts are used to secure the "C" brackets to structurally join the two vacuum modules. A jam nut is then tightened on the turnbuckle adapter to secure the adjustment.

Electrical connection between the two modules is provided by multiple strand flexible leads. Both ends of the leads are terminated in a pad which is bolted onto the moving or stationary contact supports of the adjoining modules. In the application where two modules are joined together to provide a transfer switch or capacitor switch with pre-insertion contact, as indicated below, a third terminal must be provided for connection to the electrical system.

If two modules are joined as indicated above, a double break modular vacuum switch or interrupter results. Extra modules can be added in series to provide three, four or more contact breaks for increased voltage capability. If a module with a standard adjuster is joined together with a module with an adjuster slotted to provide pre-insertion as described above, a vacuum capacitor switch with pre-insertion contact is created. The upper module would provide a pre-insertion contact function and the lower module would provide the load carrying contacts. In application, a pre-insertion resistor or inductor would be connected in series with the top of the upper module and the lower or source terminal of the lower module. The point at which the two modules were interconnected would be the load terminal. This device would find application in energizing parallel connected capacitor banks. With one stroke of the contact operating rod, the pre-insertion contacts would close first to momentarily connect the pre-insertion resistor or inductor in series with the load to dampen the capacitive inrush current. As the contact operating rod completed its stroke, the contacts in the lower module would make to carry the normal load current. Extra modules could be added to both ends of this configuration to increase the voltage capability. If two modules joined together, but the upper module is mounted upside down, a transfer switch is created. In this case, with one stroke of the contact operating rod, the contacts in the upside down module open and the contacts in the other module close. This arrangement would be used to transfer power from a preferred source to an alternate source to maintain power to a critical load. Extra modules could be added to the appropriate ends of modular configuration for increased voltage capability. The adjustment of the turnbuckle adapter at the point where the right side up and the upside down modules are joined for the transfer switch option would be performed as above with one added step. Once the nuts on the "C" brackets were tightened, the turnbuckle adapter would be adjusted the required number of turns to move the upside down contact closer to the right side up contact by a distance equal to the designed contact stroke. This special adjustment will cause one contact to be open when the other contact is closed. Extra modules can be added to the appropriate ends of modular configuration for increased voltage capability.

The invention described above is suitable for use in oil or SF6 switchgear. The contacts utilized with the invention may be of the butt style, transverse magnetic field or axial magnetic field designs as used in prior art.

A further ramification of the invention allows the modular vacuum switchgear described above to be encapsulated. This is facilitated by the addition of two added housings and a lower current exchange with appropriate electrical termination means to prevent the encapsulation material from contacting the moving components of the adjuster mechanisms.

To protect the area where the two modules are joined together, a cylindrical insulating housing is utilized including two halves split axially and bolted together to encase the adjusted mechanisms and brackets that join the two modules. The housing would contain a side hole in one of the halves into which a terminal rod may be threaded into place to facilitate a third electrical connection if required. The extra set of flexible leads indicated above would be connected to this terminal rod. If a third termination is not required, the hole in the housing would be plugged. Both ends of the housing would have a have a shoulder to form a counter bore when bolted together so that the ends would mate with the faces of the end cups on the modules.

For the upper series mounted module, the top portion must be enclosed in a housing, which also provides an electrical termination point. The housing includes a metallic cylinder with a top portion made from an insulating material. The portions of the housing are preferably held in place by fasteners that engage insulators, which are secured to studs brazed to the end-cup of the interrupter. A flexible lead transfers current from the upper floating contact support of the top module to a terminal, which exits out of a top of the housing.

For the lower series mounted module, the bottom portion must be enclosed in a way that allows an operating rod connected to the actuator to freely move. The lower housing includes an annular current exchange block that is attached to the studs at the lower end of the module. The housing has a bore of sufficient size to fit over the lower mechanism housing so that the operating rod from the actuator can be threaded onto the contact rod that extends out of a bottom of the module. A counter bore is also provided that has threaded holes to allow flexible leads to be attached from the lower housing to the floating contact support. A threaded hole is provided on the outside diameter of the lower housing to allow attachment of the lower terminal rod to facilitate connection to the electrical circuit.

The configuration described above may be encapsulated using any of the techniques established in prior art. This would provide a single solid dielectric vacuum device containing two or more vacuum modules having a minimum of two contact breaks and configurable into multiple forms of switchgear and capable of being operated by a single operating rod.

DESCRIPTION OF THE PREFERRED EMBODIMENTS

Figure 1:
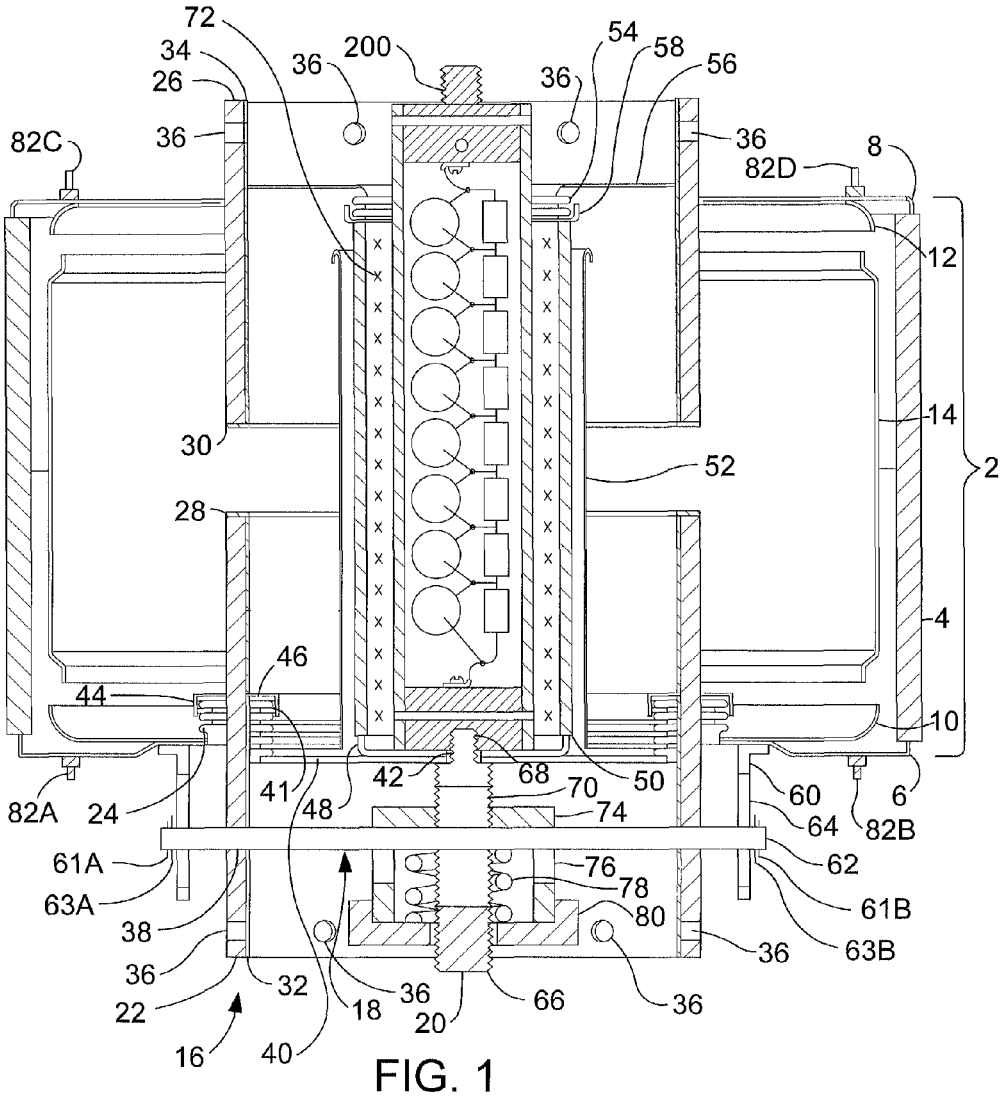
FIG. 1 is a cross-sectional view of a toroidal vacuum switch module including a vacuum envelope in accordance with the present invention.

The toroidal vacuum switch module of FIG. 1 comprises a vacuum envelope 2. A major part of the vacuum envelope 2 includes an insulating cylinder 4 preferably fabricated from alumina ceramic. The opposite ends of the insulating cylinder are enclosed by end cups 6, 8, preferably fabricated from stainless steel or monel. A triple point shield 10 preferably fabricated from stainless steel or monel is attached to the end cup 6 and a similar triple point shield 12 is attached to end cup 8. A generally tubular internal shield 14 preferably fabricated from stainless steel is provided within the insulating cylinder 4, spaced from the interior wall and overlapping the triple point shields 10 and 12 to prevent any vaporized material from contacting the interior wall thereof.

The interior of the vacuum envelope 2 includes an annular contact system 16, and a moving tubular insulating system 18 that closes off the inside diameter of the vacuum envelope 2 resulting in its toroidal shape. This toroidal structure allows the insertion of a contact drive system 20 along the axis of the vacuum envelope 2 so that the drive system 20 passes through the full length of vacuum module in a way that maintains the vacuum integrity of vacuum envelope 2 and allows the contact drive system 20 to connect to and drive successively connected modules. The contact system 16 includes an annular moving contact support 22 preferably made from copper, which is sealingly attached to the end cup 6 by a bellows 24 preferably fabricated from stainless steel and an annular stationary contact support 26 preferably from copper, which is attached to the end cup 8. A moving contact 28 and a stationary contact 30 preferably fabricated from copper-tungsten are attached to an end of the moving contact support 22 and the stationary contact support 26, respectively. Reinforcing tubes 32 and 34 preferably fabricated from stainless steel are attached to the inside diameter of both the moving contact support 22 and stationary contact support 26, respectively. The opposite end of the moving contact support 22 and stationary contact support 26 and the reinforcing tubes 32 and 34 extend outside the vacuum envelope 2 and include six threaded holes 36 equally spaced around a perimeter thereof to allow electrical connections to be made. An additional through hole 38 is placed on opposite sides of the moving contact support 22 to allow connection to the contact drive system 20. An inner diameter of the reinforcing tube 32 is sealing connected to a drive plate 40 preferably fabricated from stainless steel by a bellows 41 preferably fabricated from stainless steel. The drive plate 40 has a hole 42 to facilitate attachment of the drive system 20. A set of bellows shields 44 and 46 preferably fabricated from stainless steel protect the bellows 24 and 41 from damage due to vaporized contact materials. The drive plate 40 also drives the moving insulating system 18. An end cup 48 preferably fabricated from stainless steel or monel is attached to drive plate 40 and a tubular insulator 50 preferably fabricated from an alumina ceramic is attached to the opposite end of the end cup 48. A tubular shield 52 preferably fabricated from stainless steel is also attached to the drive plate 40. The tubular shield 52 protects an outside surface of the tubular insulator 50 to prevent metallic vapors from depositing on the insulating surface. The opposite end of the tubular insulator 50 is attached to a bellows 54 preferably fabricated stainless steel, which is sealingly attached to an end plate 56 preferably fabricated from stainless steel or monel. The end plate 56 is attached to the inside diameter of the reinforcing tube 34 to seal off the vacuum envelope 2. A bellows shield 58 preferably fabricated from stainless steel protects the bellows 54 from damage due to vaporized contact materials.

A housing 60 preferably fabricated from stainless steel is attached to end cup 6 and is centered by the circular depression formed in the end cup 6. The housing 60 is indexed to the moving contact support 22 preferably by a nickel plated hardened steel pin 62, which passes through the cross-hole 38 in the moving contact support 22 and the reinforcing tube 32 and slides in a slot 64 in the housing 60. During the brazing cycle for the vacuum switch, pin 62 is preferably replaced by a stainless steel fixture pin to assure the alignment of these parts. After the brazing cycle, the fixture pin is partially removed to allow attachment of the contact drive system 20. A contact drive rod 66 preferably fabricated from steel is positioned, so that a stud 68 formed on the end of the contact drive rod 66 protrudes into the hole 42 in the drive plate 40. A slot 70 in the contact drive rod 66 is aligned with the fixture pin and then the fixture pin is again fully installed. A capacitive voltage divider drive rod 200, described in detail below, is tightened onto the threaded stud 68 formed on the contact drive rod 66. Once the capacitive voltage divider drive rod 200 is tightened on to the stud 68, a space between the capacitive voltage divider drive rod 200 and the inner diameter of the tubular insulator 50 is preferably filled with epoxy 72 for improved dielectric performance. The epoxy fill must be controlled so that no epoxy is allowed to contact the inside surface of the bellows 54. The fixture pin is removed and an adjuster 74 preferably fabricated from brass is then threaded onto the body of the contact drive rod 66. The adjuster 74 has six slots 76 equally spaced around its perimeter so that pin 62 can be inserted into any opposite facing pair of slots 76 during the adjustment process. The adjuster 74 is positioned so that the one pair of slots 76 line up with the cross hole 38 in the moving contact support 22 and reinforcement tube 32 and the end of slot 76 closest to the vacuum envelope 2 aligns with cross-hole 38. During this adjustment, the contacts 28 and 30 must be open and the moving contact support 22 must be fixtured in a full open position. The pin 62 is then inserted back through the housing 60, the moving contact support 22, the reinforcement tube 32 and the adjuster 74. The pin 62 is held in place by a pair of retaining rings 61A and 61B and a pair of washers 63A and 63B. A compression spring 78 preferably made of music wire is inserted into the counter-bore in adjuster 74 and preferably a threaded nickel-plated steel spring retainer 80 is tightened onto the end of adjuster 74. This forces the pin 62 to the end of the slot 76 closest to the vacuum envelope 2. The length of the slots 76 in the adjuster 74 are equal to the designed compression of the spring 78 to supply the required contact pressure plus preferably 0.031 inch. The slots 64 in the housing 60 and the slot 70 in contact drive rod 66 have a minimum length equal to the tolerance build-up between the location of contacts 28 and 30 plus the length of the slots 76 in the adjuster 74, when the contacts are open. This allows the adjuster 74 to be able to be adjusted through the full range of possible locations of cross-hole 38 in moving contact support 22.

The above adjustment procedure applies to the application of the toroidal vacuum module in a standard switching or interruption application. If the vacuum module is to be applied as a pre-insertion module for a capacitor switch as described below, the length of the slots 76 in the adjuster 74 are equal to a required pre-insertion contact travel distance plus the distance required for contact pressure in the standard switching module above. In this case, the adjuster 74 is adjusted so that the end of the slot 76 furthest from the vacuum envelope 2 is preferably 0.031 inch further away from the vacuum envelope 2 than the cross hole 38 in the contact support 22 with the contacts fully closed.

Figure 2:
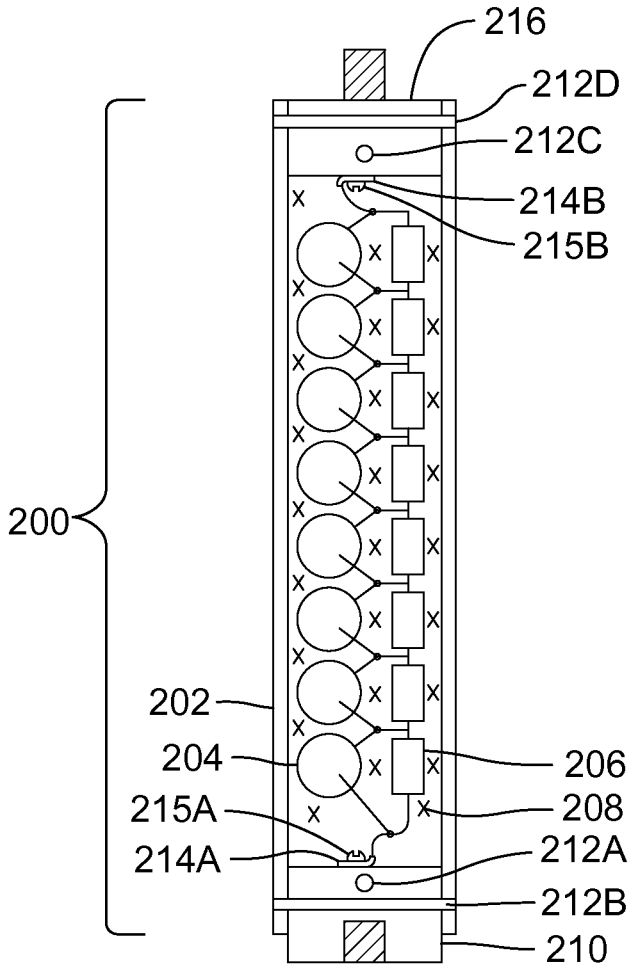
FIG. 2 is a cross-sectional view of a capacitive voltage divider drive rod of a toroidal vacuum switch module in accordance with the present invention.

The toroidal vacuum module requires a capacitive voltage divider drive rod to distribute the voltage equally between the contact gaps of adjoining vacuum modules during interruption. As shown in FIG. 2, this is provided by the operating rod 200. The Operating rod 200 preferably includes a filament wound epoxy glass insulating tube 202 of sufficient diameter to allow the insertion of a disc capacitor 204 connected in parallel with a carbon resistor 206. The rating of the capacitor and resistor depends on the voltage rating of the stack of vacuum modules. In the case of a stack having just two modules, the disc capacitor has preferable rating of 500 pf 30 kV and the resistor has a preferable rating of 20 Meg-ohm 2 watts. For this particular example, eight of these capacitor-resistor units are connected in series inside of the insulating tube 202 and the insulating tube 202 is filled with an epoxy 208 to improve dielectric characteristics. In the case where only two modules are to be joined, when the lower module is connected to the drive mechanism, a similar, longer capacitor voltage divider drive rod as described above and containing 16 series connected capacitor-resistor units would be required to balance the voltage. This is referred to as a capacitive voltage divider operating rod 508 below and show in FIGS. 10-12. An end of the contact drive rod 200 connected to the drive plate 40 of the vacuum module contains an adapter 210 to thread on to the stud 68 of the contact drive rod 66. The adapter 210 is pinned to the insulating tube 202 with steel roll pins or groove pins 212A and 212B and preferably includes a tin plated brass terminal 214A held in place with a screw 215A preferably fabricated of tin plated steel to allow connection of one end of the capacitor-resistor network. The other end of the insulating tube 202 contains an adapter 216 preferably fabricated of steel, which is threaded to allow the operating rod 200 to be connected to a turnbuckle adapter 302 described below. The adapter 216 is pinned to the insulating tube 202 with steel roll pins or groove pins 212C and 212D and preferably includes a tin plated brass terminal 214B held in place with a screw 215B preferably fabricated of tin plated steel to allow connection of the other end of the capacitor-resistor network.

To facilitate series interconnection of modules, studs 82A-82D are attached to both end cups 6 and 8. These are aligned to allow the attachment of a pair of inter-module brackets 300A and 300B preferably fabricated of steel between modules as is indicated below.

Figure 3:
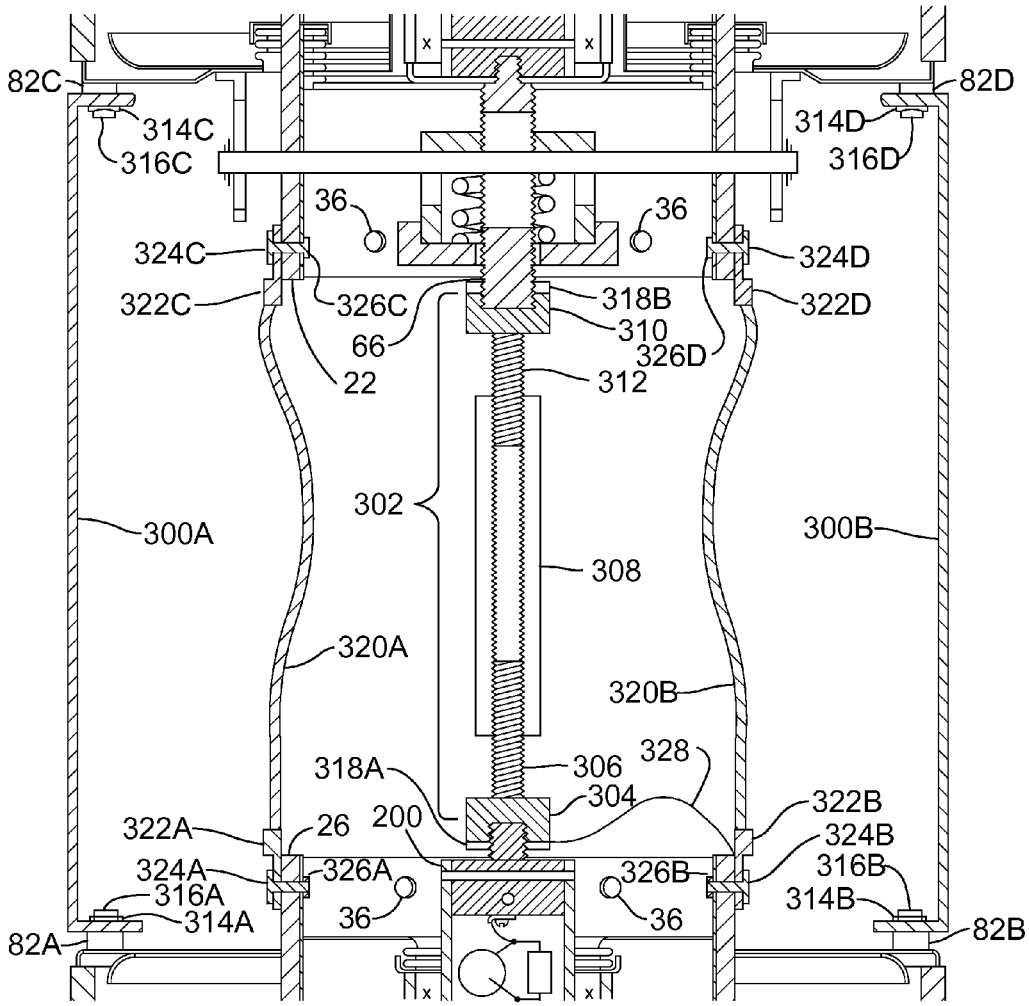
FIG. 3 is a cross-sectional view of a turnbuckle adapter for interconnecting two adjacent toroidal vacuum switch modules in accordance with the present invention.

Two or more modules may be connected together to produce switchgear configurations containing two, three, four or more contact breaks. To facilitate interconnection of the modules, the turnbuckle adapter 302 is threaded on to the capacitive voltage divider drive rod 200 of the first module as shown in FIG. 3. The turnbuckle adapter 302 preferably includes a nickel-plated steel turnbuckle body 308, which has a left hand thread on the lower section and a right hand thread on the upper section. An adapter 304 preferably fabricated of nickel-plated steel includes a left hand thread 306 and couples the turnbuckle body 308 to the capacitive voltage divider drive rod 200 on the lower module. An adapter 310 preferably fabricated of nickel-plated steel includes a right hand thread 312 and couples the turnbuckle body 308 to the contact drive rod 66 of the upper module. The contact drive rod 66 is threaded onto the other end of the turnbuckle body 308 and the turnbuckle adapter 302 is adjusted, until a point is reached where the inter-module brackets 300A and 300B fit snugly between the faces of the studs 82A-82D. This adjustment is performed in a way, so that neither operating rod is moved relative to their respective vacuum envelopes. Once the adjustment is completed, washers 314A-314D and elastic stop nuts 316A-316D are tightened onto the studs 82A-82D to secure the brackets 300A and 300B. A jam nut 318A and 318B is tightened against the both ends of the turnbuckle adapter 302 to secure the adjustment. In order to transfer current from the lower to the upper vacuum modules, a pair of highly flexible multi-stranded copper conductors 320A and 320B are connected between the stationary contact support 26 of the lower module and the moving contact support 22 of the upper module. Ends of conductors 320A and 320B are crimped to terminals 322A-322D preferably fabricated of copper, which are secured to the moving contact support 22 and the stationary contact support 26 preferably with phosphor bronze nuts 326A-326D and bolts 324A-324D. This same arrangement would be used if a vacuum capacitor switch with pre-insertion contact is to be created, except the upper module would contain an adjuster 74 with the slots 76 designed for this application as indicated above. The capacitor switch also requires a third terminal connection. This would be provided by a flexible copper lead (not shown) similar to conductors 320A and 320B above that would be connected to either the moving contact support 22 or the stationary contact support 26 utilizing any of the open holes 36. Extra modules can be added to the appropriate ends of both modular configurations for increased voltage capability utilizing additional turnbuckle adapters 302 as required. These configurations are suitable for use in oil or SF6 gas insulated switchgear.

If two modules are joined together with the turnbuckle adapter 302, but the upper module is mounted upside down, a double break transfer switch is created. For a transfer switch, the capacitive voltage divider drive rods from each module will be connected together by the turnbuckle adapter 302. In this case, a flexible lead 328 is connected from between the turnbuckle adapter 302 and the jam nut 318A to the stationary contact support 26 to maintain the ability of the capacitive voltage divider drive rod 200 to balance the voltage between all interconnected contacts. The turnbuckle adapter 302 is adjusted as above to secure the brackets 300A and 300B. However, before the jam nut is tightened, the turnbuckle adapter 302 is rotated a set number of turns to pull the capacitive voltage divider drive rod 200 of the upper module toward the capacitive voltage divider drive rod 200 of the lower module by the designed contact stroke distance. In addition, the transfer switch also requires a third terminal connection. This would be provided a flexible copper lead (not shown) similar to copper conductors 320 that would be connected to either the moving contact support 22 or the stationary contact support 26 utilizing any open holes 36. When the transfer switch operates, the contacts in the upside down module open and the contacts in the other module close. This arrangement would be used to transfer power from a preferred source to an alternate source to maintain power to a critical load. Extra modules can be added to the appropriate ends of modular configuration for increased voltage capability. This configuration is suitable for use in oil or SF6 gas insulated switchgear.

Figure 4:
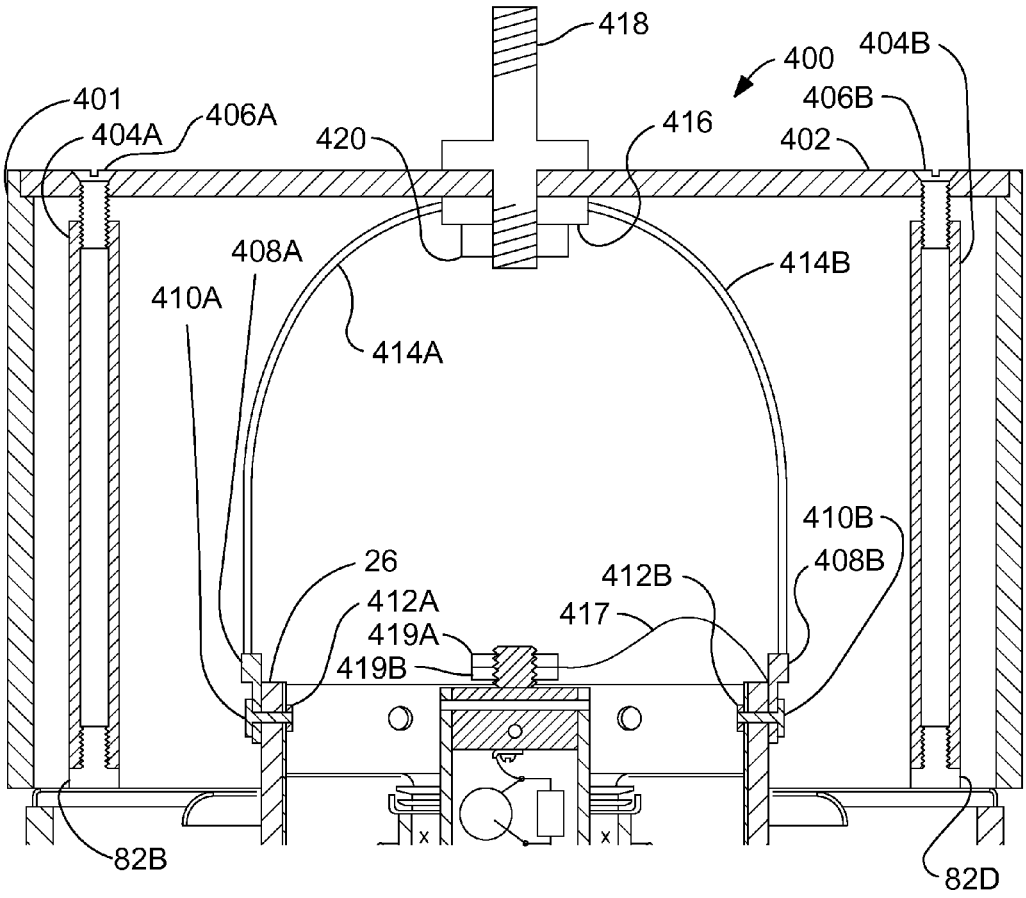
FIG. 4 is a cross-sectional view of a housing placed over an upper portion of a toroidal vacuum switch module in accordance with the present invention.

The switchgear configurations described above may also be utilized in encapsulated switchgear by the addition of protective housings to prevent the encapsulating material from contacting moving parts and to provide sealed electrical connection points. In order to facilitate encapsulation of multiple toroidal vacuum modules; a housing 400 is placed over the upper mechanism as shown in FIG. 4. The housing 400 includes a mechanism housing 401 preferably fabricated of an aluminum and a cover 402, which may be made of an insulating material such as GP01 or GP03 fiberglass or G10 epoxy glass. An insulating stringer 404A and 404B preferably made of filament wound epoxy glass is threaded onto each stud 82B and 82D. Screws 406A and 406B preferably fabricated of stainless steel is threaded into an opposite end of each stringer 404A and 404B to retain the cover 402 and the mechanism housing 401. A pair of connectors 408A and 408B preferably made of copper are tightened onto the end of the stationary contact support 26 using bolts 410A and 410B and nuts 412A and 412B. A pair of highly flexible multi-stranded copper conductors 414A and 414B are crimped to the connectors 408A and 408B and to a terminal connector 416. The terminal connector 416 is threaded onto the lower portion of a copper terminal rod 418 and secured with a jam nut 420 preferably fabricated of phosphor bronze; creating a current exchange between the stationary contact support 26 and the terminal rod 418. The terminal rod 418 allows connection to the line voltage. A flexible lead 417 is connected from the end of the capacitive voltage divider drive rod 200 using a pair of nuts 419A and 419B to the stationary contact support 26 to provide a solid connection from the voltage balancing capacitive network to the stationary contact support 26.

Figure 5:
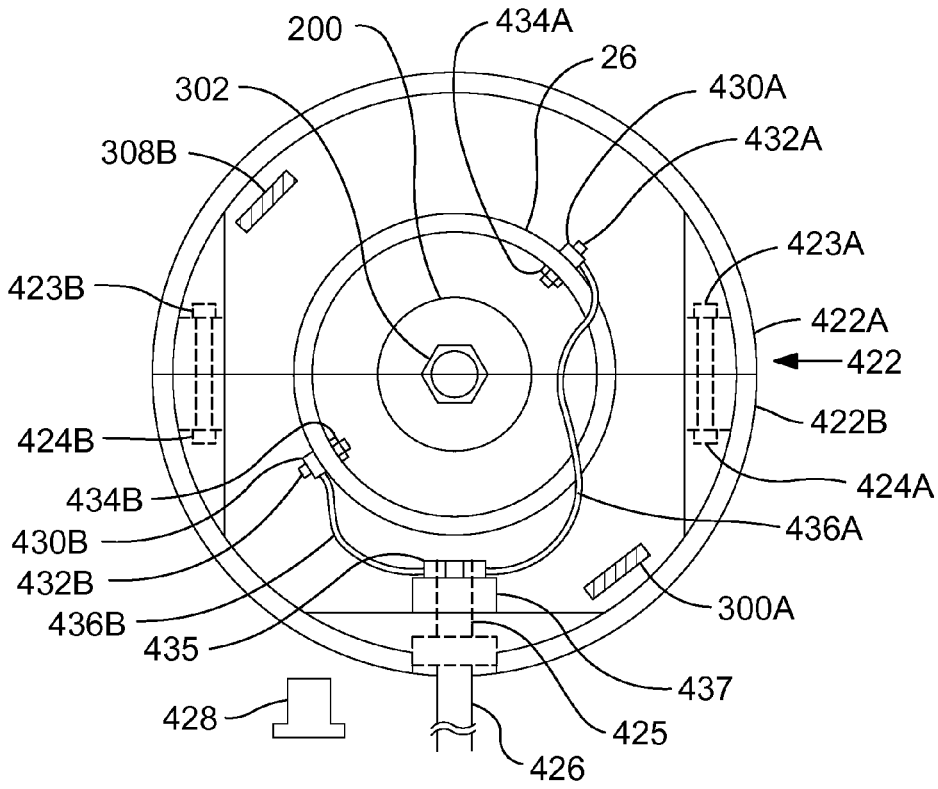
FIG. 5 is a top view of a housing placed over an upper portion of a toroidal vacuum switch module cut through a turnbuckle adapter in accordance with the present invention.

The area between any interconnected modules is preferably sealed by a split thermoset plastic housing 422, which is held together with a pair of steel bolts 423A and 423B and a pair of steel nuts 424A and 424B as shown in FIG. 5. Two housing halves 422A and 422B of the housing 422 together encase brackets 300A and 300B and interconnecting components of the two joined modules. The housing half 422B contains a side hole 425 into which a terminal rod 426 may be threaded into place, to facilitate a third electrical connection to line voltage, if required. If a third termination is not required, the hole in the housing half 422B would be preferably plugged with a thermoset plastic plug 428. If required, a pair of terminals 430A and 430B preferably made from copper are tightened on to the end of the stationary contact support 26 using a pair of bolts 432A and 432B and nuts 434A and 434B preferably made from phosphor bronze. A pair of highly flexible multi-stranded copper conductors 436A and 436B are crimped to the terminals 430A and 430B and to a terminal connector 437. The terminal connector 437 is threaded on to the lower portion of a copper terminal rod 426 and preferably secured with a phosphor bronze jam nut 435; creating a current exchange between the stationary contact support 26 and the terminal rod 426. The terminal rod 426 allows connection to the line voltage.

Figure 6:
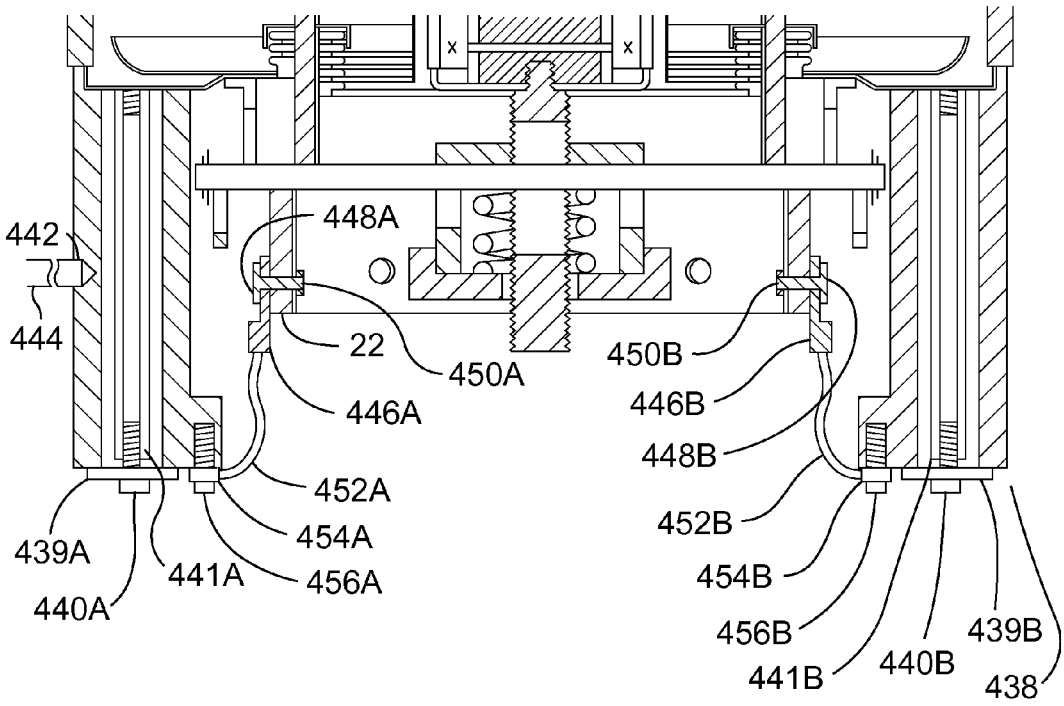
FIG. 6 is a cross-sectional view of a bottom of a torodial vacuum switch module in accordance with the present invention.

The lower end of the stacked vacuum module assembly is prepared for encapsulation by installation of a current exchange housing 438 preferably fabricated of copper over the housing 60 and securing it with a pair of stainless steel bolts 440A and 440B, washers 439A and 439B and threaded spacers 441A and 441 B, which is shown in FIG. 6. A threaded hole in the current exchange housing 442 allows the attachment of a terminal rod 444 preferably made of copper. A pair of terminals 446A and 446B preferably made of copper are tightened onto the end of the moving contact support 22 using a pair of bolts 448A and 448B and nuts 450A and 450B preferably made from phosphor bronze. A pair of highly flexible multi-stranded copper conductors 452A and 452B are crimped to the terminals 446A and 446B and to a second pair of terminals 454A and 454B preferably made of copper. The terminals 454A and 454B are attached to the current exchange housing 438 using a pair of bolts 456A and 456B preferably made from phosphor bronze; creating a current exchange between the moving contact support 22 and the current exchange housing 438. This completes the circuit to terminal rod 444 allowing connection to line voltage.

Figure 7:
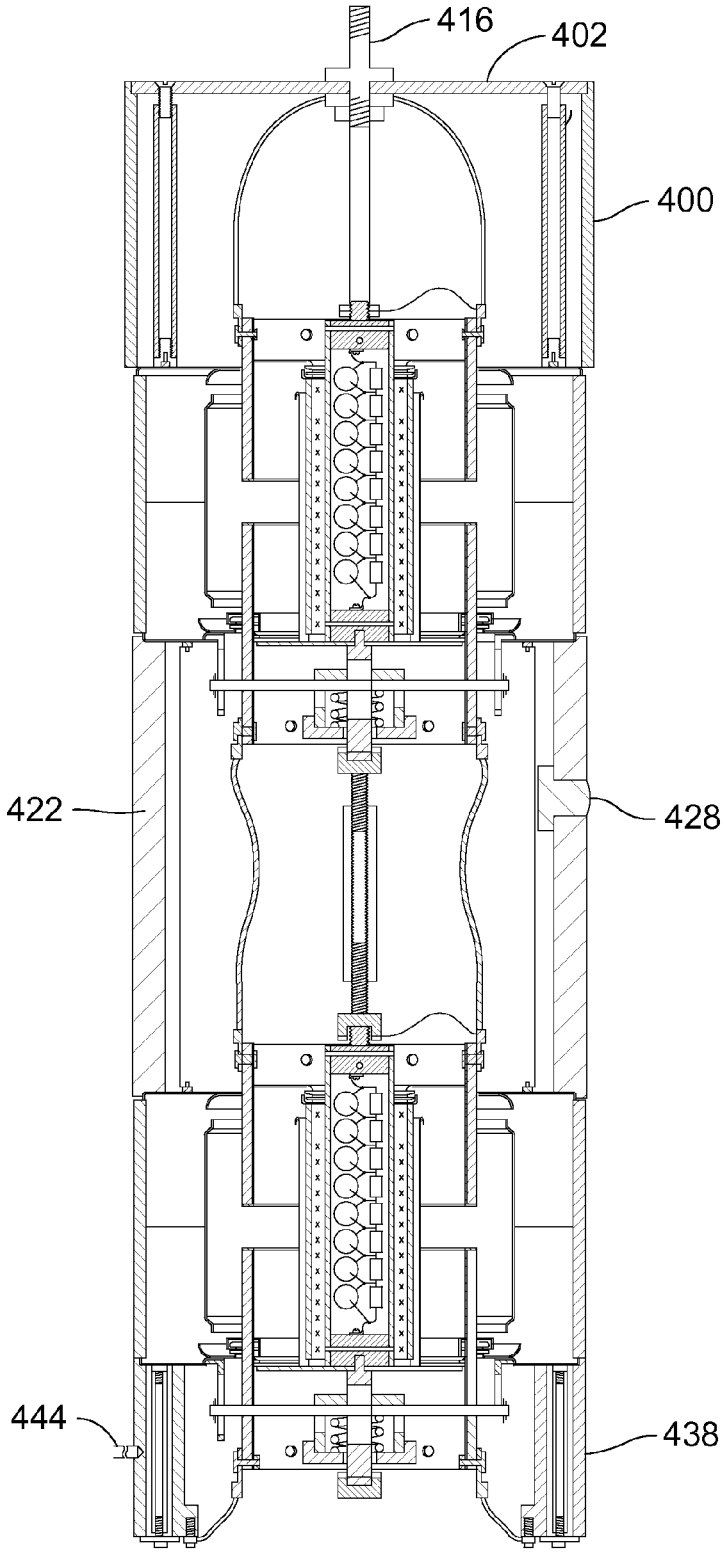
FIG. 7 is a cross-sectional view of two toroidal vacuum switch modules stacked together to form a double break switch in accordance with the present invention.
Figure 8:
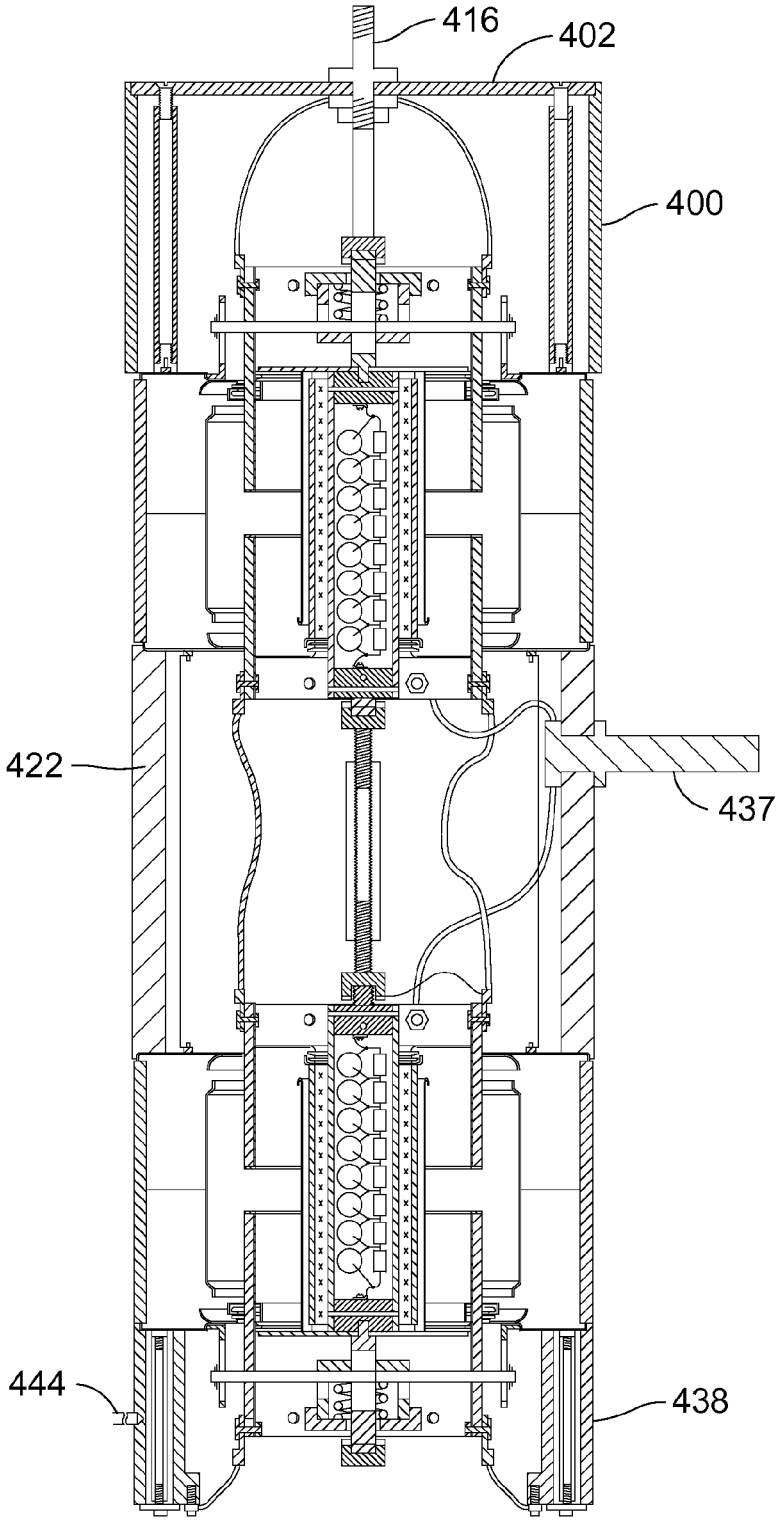
FIG. 8 is a cross-sectional view of two toroidal vacuum switch modules stacked together to form a single break transfer switch in accordance with the present invention.
Figure 9:
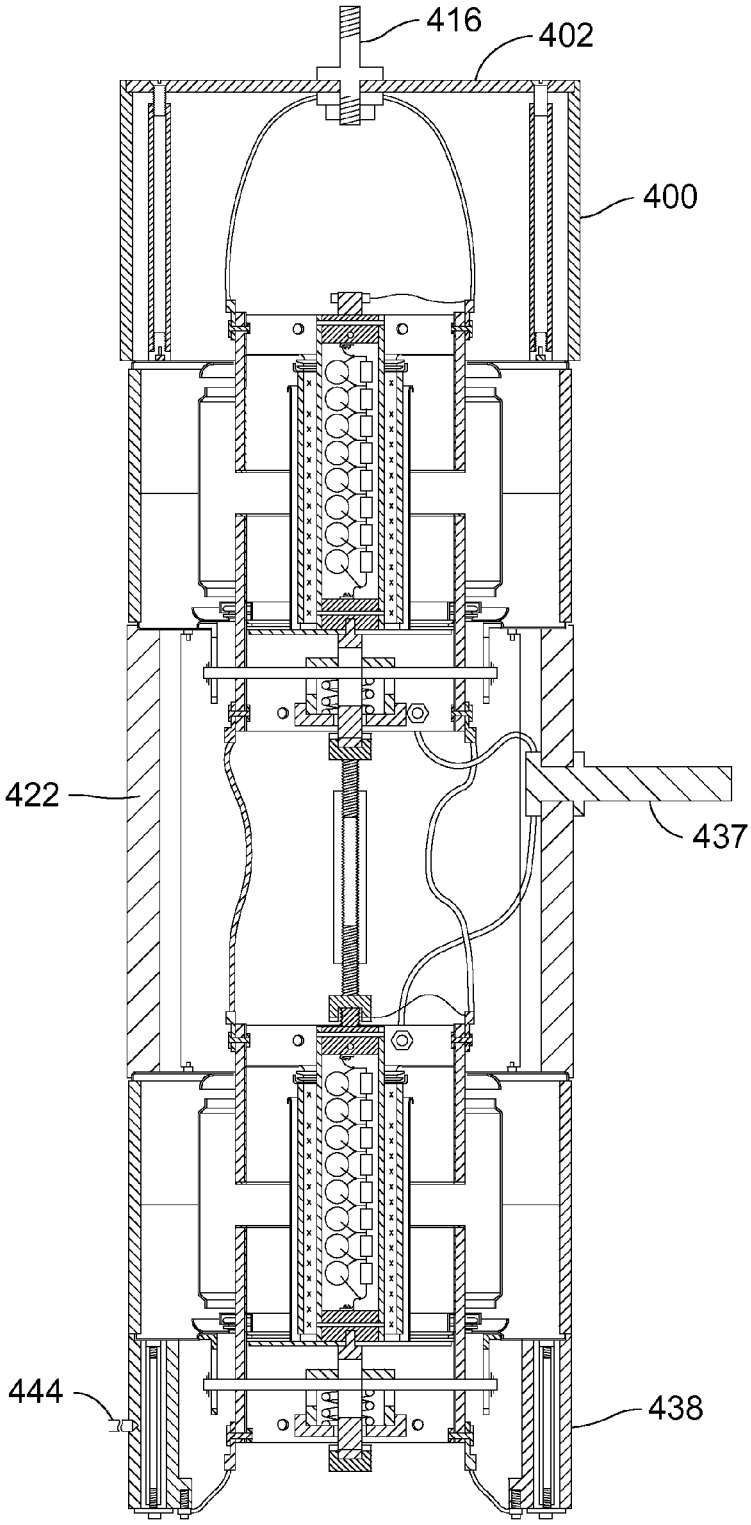
FIG. 9 is a cross-sectional view of two toroidal vacuum switch modules stacked together to form a single break capacitor switch with pre-insertion contacts in accordance with the present invention.

In the case of two modules stacked together and prepared as indicated above, a double break switch, single break transfer switch and single break switch with pre-insertion contacts would appear as shown in FIG. 7, FIG. 8 and FIG. 9, respectively. Increased voltage handling capability would be obtained if four modules were utilized, as the number of contact breaks for each type of switching device would double and so on.

Figure 10:
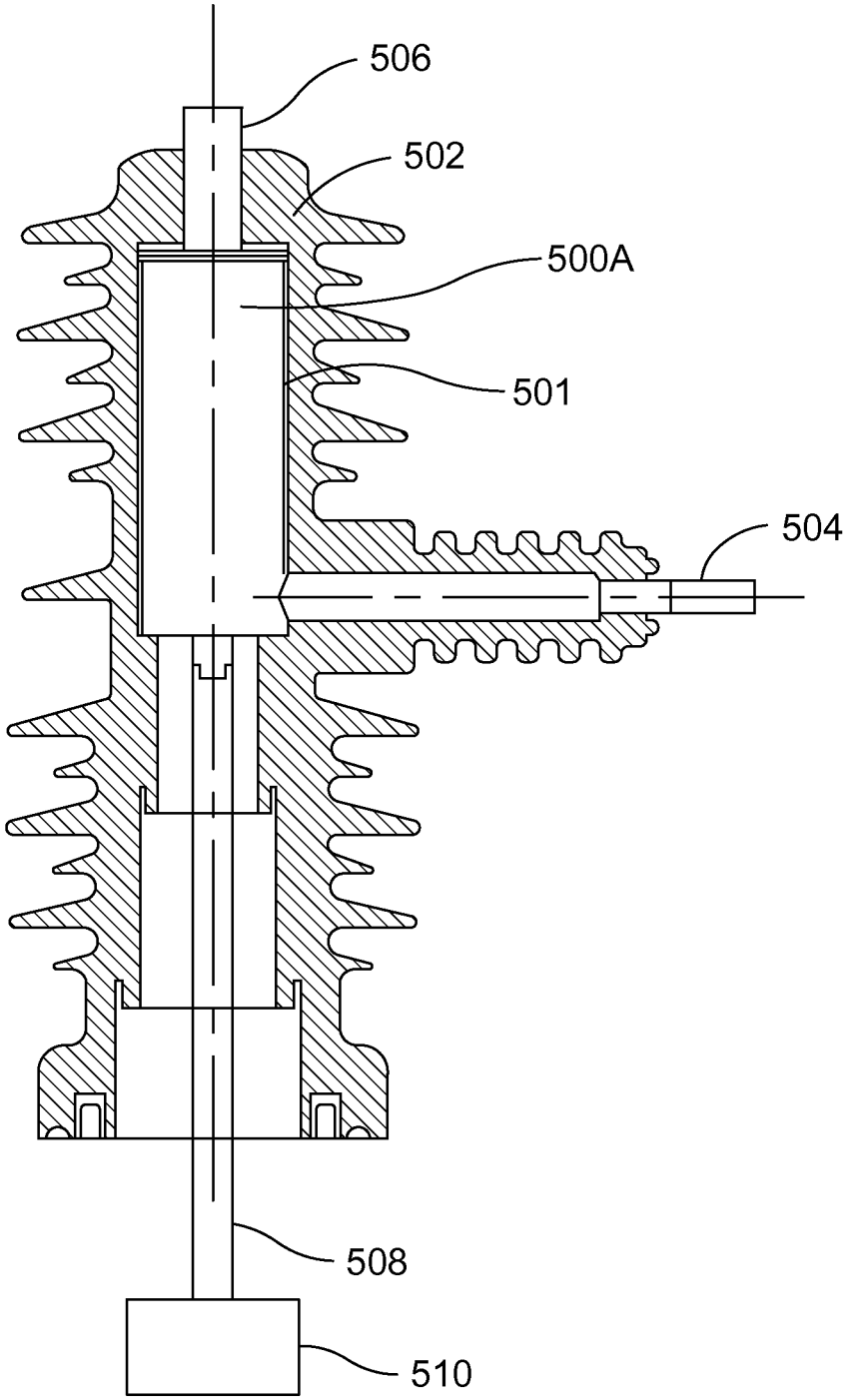
FIG. 10 is a cross-sectional view of an encapsulated toroidal vacuum switch module in accordance with the present invention.

There are several examples of prior art, which show the encapsulation of vacuum modules. FIG. 10 indicates one possible way of encapsulating the aforementioned vacuum switch as demonstrated by U.S. Pat. No. 5,917,167. In this case, the stacked module assembly shown in FIG. 7, 500A is encased in a silicone rubber tube 501 and cast in an epoxy encapsulation 502. The result is a two terminal encapsulation with a source terminal 504 and a load terminal 506.

In operation as the aforementioned case where two stackable modules are combined, the encapsulated double break vacuum switch would be coupled via a capacitive voltage divider operating rod 508 to an operating mechanism 510. The capacitive voltage divider operating rod 508 would be of similar capacitive voltage divider construction as the capacitive voltage divider drive rod 200. An upward closing stroke of a mechanism 510 and the capacitive voltage divider operating rod 508 would drive the contact drive rod 66 upward. This upward movement is transferred through the lower vacuum module by the capacitive voltage divider drive rod 200 and then to the turnbuckle adapter 302. Because of the aforementioned turnbuckle adjustment, the contact drive rod 66 of the upper vacuum module moves in unison with that of the lower module. This causes the two sets of contacts 28, and 30 in both vacuum modules to close simultaneously. As the operating rod 508 continues its closing stroke, the pin 62 in both vacuum modules is driven toward the opposite end of the slot 76 in both adjusters 74. This compresses the spring 78 in both adjusters 74 and provides independent contact pressure to each module. With the completion of the closing stroke, the electric current flows from the source terminal 504 through the two series connected sets of contacts 28 and 30 and directly out the load terminal 506.

Upon initiation of the opening stroke, the capacitive voltage divider operating rod 508 moves downward, causing the contact drive rod 66 of both vacuum modules to move downward. The energy stored in the spring 78 forces the pin 62 in both vacuum modules upward maintaining contact through the contacts 28 and 30, until the pin 62 is driven to the top of slot 76 for both vacuum modules. At this point, the moving contact drivers 22 for both modules follow the capacitive voltage divider operating rod 508 downward and the contacts 28 and 30 in both modules begin to part initiating two separate arcs. The capacitor-resistor network contained in the capacitive voltage divider drive rod 200 and the capacitive voltage divider drive rod 508 act to distribute the voltage evenly across the two contact gaps, resulting in an efficient interruption of the arc as the capacitive voltage divider operating rod 508 completes its opening stroke and provides the full open gap for contacts 28 and 30 in both vacuum modules. Because both sets of contacts are electrically connected in series, this results in two breaks of the arc when the contacts open allowing the vacuum interrupter to be utilized at elevated voltages.

Figure 11:
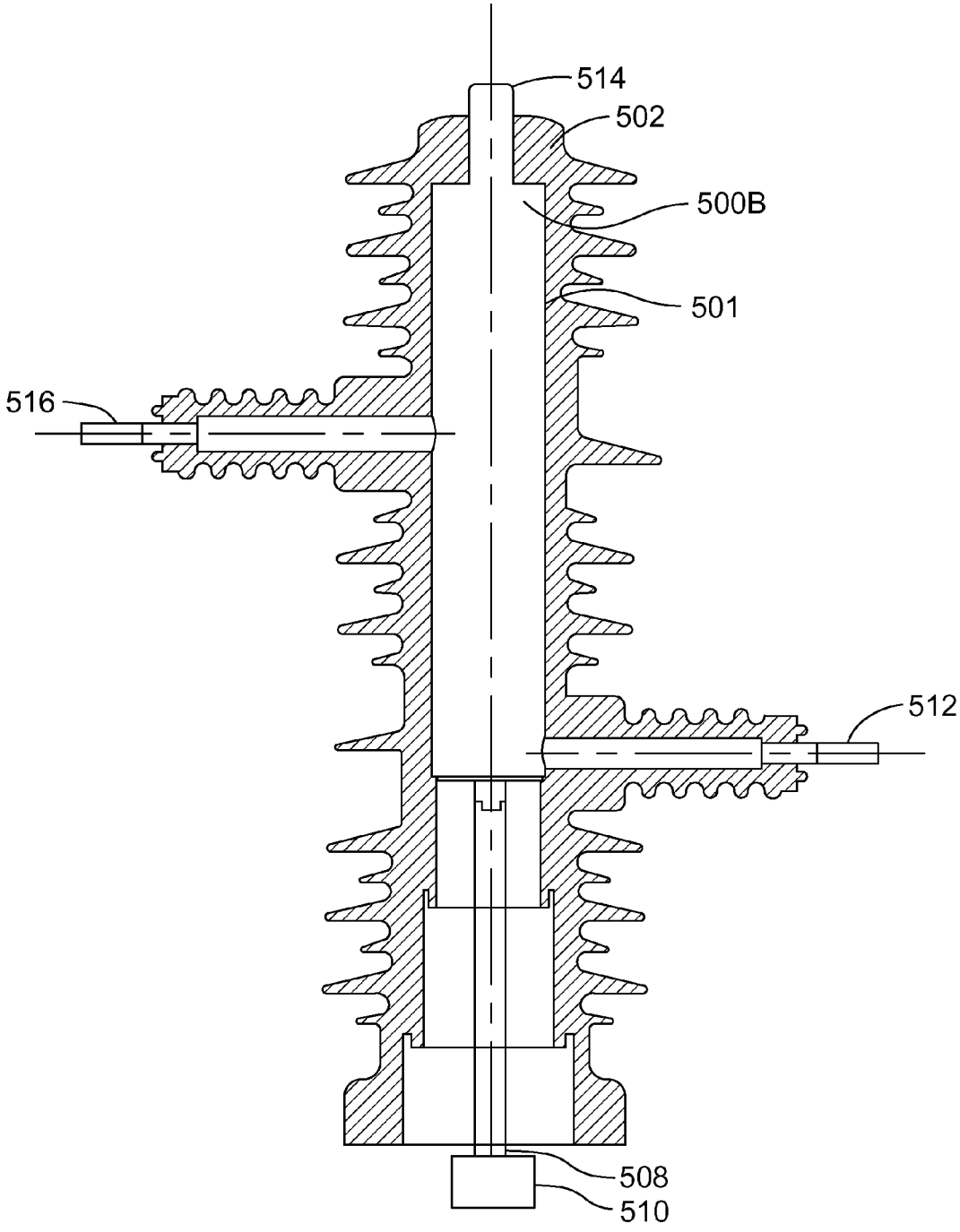
FIG. 11 is a cross-sectional view of a second embodiment of an encapsulated toroidal vacuum transfer switch module in accordance with the present invention.

In the case where a single break transfer switch is created, the encapsulation would be performed using the stacked module assembly of FIG. 8, 500B as shown on FIG. 11. The module assembly 500B is preferably encased in a silicone rubber tube 501 and cast in an epoxy 502. However, the resulting encapsulation has three terminals, an alternate source terminal 512, a primary source terminal 514 and a load terminal 516. The operation is the same as described above except with the upper module mounted upside down and the turnbuckle adapter 302 (not shown) adjusted as described previously. The contacts in the upper module would break during a portion of the stroke of the operating rod 508 that causes the contacts in the lower module to make and vice versa. In this contact arrangement, with the capacitive voltage divider operating rod 508 in the lower position, current would flow from the primary source terminal 514 through contacts 28 and 30 in the upper module to the load terminal 516. When the primary power source fails, capacitive voltage divider operating rod 508 moves to the upper position by action of the operating mechanism 510. This breaks the circuit through the upper module and causes the contacts 28 and 30 in the lower module to make. This provides for current flow from the alternate source terminal 512 through the contacts 28 and 30 in the lower module to the load terminal 516. This provides for the rapid transfer of power from a preferred source to an alternate source to maintain power to a critical load with one stroke of the contact operating rod.

Figure 12:
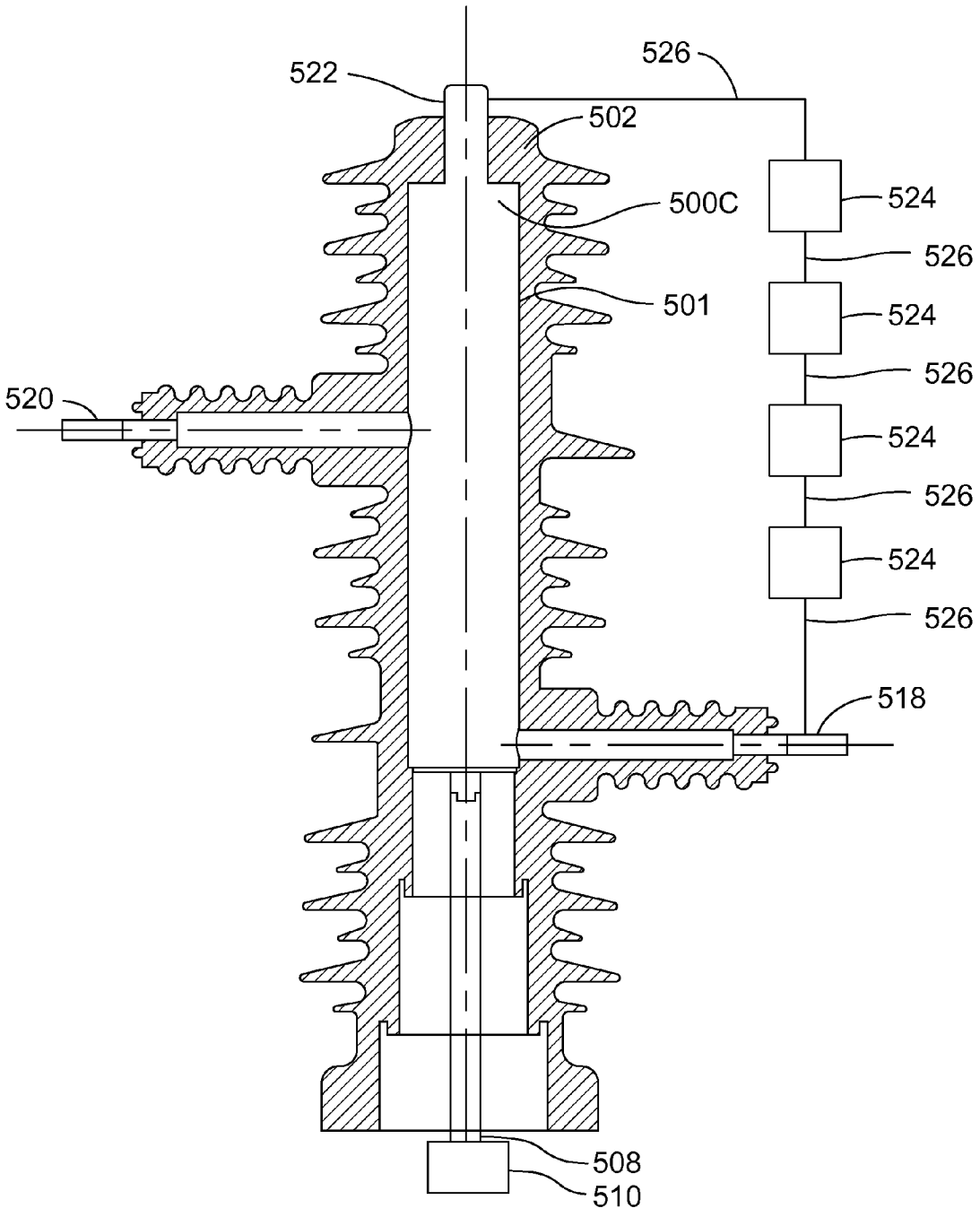
FIG. 12 is a cross-sectional view of a second embodiment of an encapsulated toroidal vacuum capacitor switch module with a group of pre-insertion resistors or inductors connected from a source terminal to a pre-insertion terminal in accordance with the present invention.

In the case where a single break capacitor switch with pre-insertion resistor is created, the encapsulation would be performed using the stacked module assembly of FIG. 9, 500C as shown on FIG. 12. The module assembly 500C is encased in a silicone rubber tube 501 and cast in an epoxy 502. However, the resulting encapsulation has three terminals, a primary source terminal 518, a load terminal 520 and a pre-insertion terminal 522. A group of pre-insertion resistors or inductors 524 are connected from the source terminal 518 to the pre-insertion terminal 522 using suitable conductive brackets 526. The operation is the same as the assembly with two modules stacked together described above except with the special adjustment as described previously, the contacts 28 and 30 in the upper module would make in advance of the contacts 28 and 30 in the lower module as the capacitive voltage divider operating rod 508 moves upward. As indicated previously, the amount of time the contacts in the upper module are advanced is determined by the contact speed and designed pre-insertion time. With this contact arrangement, as the capacitive voltage divider operating rod 508 moves upward, the contacts in the upper module make first allowing capacitive inrush current to flow from the source terminal 518 through the pre-insertion resistors or inductors 524 to the pre-insertion terminal 522, through contacts 28 and 30 in the upper module to the load terminal 520. This action damps the inrush current to prevent damage to equipment connected to the electrical line. As operating rod 508 continues upward, the pin 62 in the upper vacuum module moves upward in the elongated cross slot 76 in the adapter 74, which allows the contacts 28 and 30 in the lower module to close. This completes a circuit that allows current to flow directly from the source terminal 518 through contacts 28 and 30 of the lower module to the load terminal 520. This bypasses and shorts out the pre-insertion contacts allowing the unrestricted and efficient flow of load current. During the opening operation, the contacts 28 and 30 in the lower module open first as the discharge of the spring 78 in the adapter 74 of the upper vacuum module holds the contacts 28 and 30 in the upper module closed. This allows current to again flow through contacts 28 and 30 of the upper module and the pre-insertion resistors or inductors 524, which results in no arcing of the contacts 28 and 30 in the lower module. As the capacitive voltage divider operating rod 508 continues its opening stroke, the pin 62 will strike the end of the elongated cross slot 76 on the adapter 74 in the upper module and cause the contacts 28 and 30 in the upper module to part initiating an arc. The fact that the pre-insertion resistors are in the circuit combined with the action of the capacitive voltage divider drive rod 200 and capacitive voltage divider operating rod 508 result in reduced transients and efficient extinguishing of the arc as the capacitive voltage divider operating rod 508 continues its stroke to the full open position.

For all three types of encapsulated switchgear described above, modules can be added to the appropriate ends of the modular configurations described above for increased voltage capability. If this is done, a variety of multiple break modular switchgear can be created.

Figure 13:
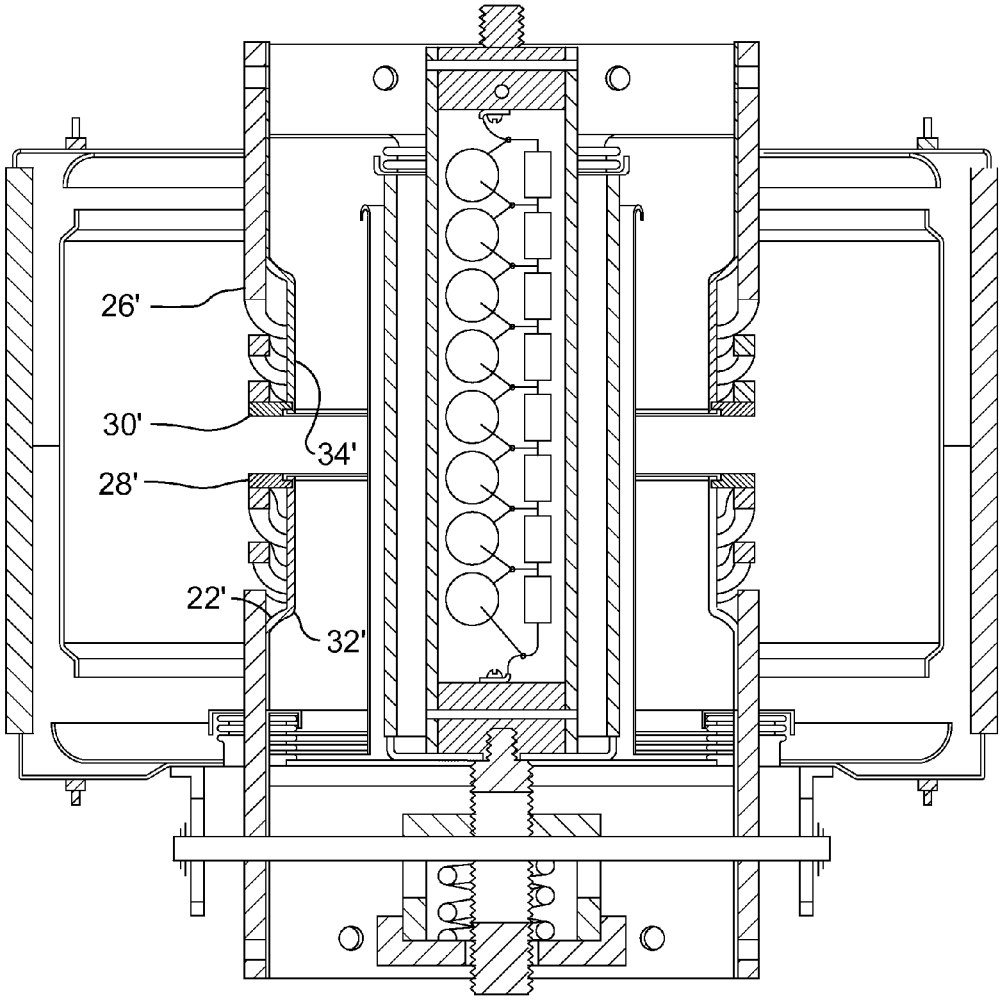
FIG. 13 is a cross-sectional view of a toroidal vacuum switch configured as a vacuum interrupter module with axial magnetic field contacts in accordance with the present invention.

In another embodiment of the double break stackable vacuum switch, the contacts 28, 30 normally fabricated from copper-tungsten are replaced with copper chromium contacts utilizing any of the transverse or axial magnetic field contact structures shown in prior art that are capable of being adapted to an annular configuration. FIG. 13 shows one possible axial magnetic field contact structure as demonstrated by U.S. Pat. Nos. 4,871,888 and 6,867,385 and US Pat App No. 2006/0016787, which are hereby incorporated into this application by reference in their entirety. This revised contact structure converts the contacts 28' and 30' from switching duty to fault interrupting duty and results in a vacuum interrupter module. In this contact structure, the moving contact support 22' and stationary contact support 26' have spiral slots cut into their walls as indicated in the US Patents cited above. The faces of contacts 28' and 30' are broadened and are supported by modified reinforcement tubes 32' and 34' which have a neck of reduced diameter to engage and support the inside diameter of contacts 28' and 30' by being formed around a lip on the inside diameter of said contacts.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vacuum switch module comprising:

a vacuum enclosure;

a contact system includes a moving contact and a stationary contact, said first contact system is located inside said vacuum enclosure;

an adjuster includes an adjustment mechanism and a drive rod, said adjuster is mounted to said moving contact, said adjuster changes a distance between said moving contact and said stationary contact; and an operating rod having a first end and a second end, said operating rod is retained adjacent said contact system, said first end of said operating rod is secured to the other end of said drive rod, said operating rod includes a capacitor resistor network.

2. The vacuum switch module of claim 1, further comprising:

said moving contact has an annular shape and is mounted to a moving annular contact support and said stationary contact has an annular shape and is mounted to a stationary annular contact support.

3. The vacuum switch module of claim 1 wherein:

said operating rod is positioned inside said moving contact and said stationary contact.

4. The vacuum switch module of claim 1 wherein:

said operating rod is insulated from said vacuum envelope by a coaxial moving tubular insulator.

5. The vacuum switch module of claim 1 wherein:

said drive rod and said operating rod enable at least two similar vacuum devices to be operated together.

6. The vacuum switch module of claim 1 wherein:

said adjustable mechanism includes a housing, an adjustable spring retainer, a spring and said drive rod, said spring is retained between said housing and said adjustable spring retainer, rotation of said adjustable spring retainer relative to said housing changes a position between said moving contact and said stationary contact.

7. A vacuum switch module comprising:

a vacuum enclosure;

a contact system includes a moving contact and a stationary contact, said first contact system is located inside said vacuum enclosure, said moving contact having an annular shape, said stationary contact having an annular shape;

an adjuster includes an adjustment mechanism and a drive rod, said adjuster is mounted to said moving contact, said adjuster changes a distance between said moving contact and said stationary contact; and an operating rod having a first end and a second end, said operating rod is positioned inside said moving contact and said stationary contact, said first end of said operating rod is secured to the other end of said drive rod, said operating rod includes a capacitor resistor network, wherein said operating rod passes along the main axis of said vacuum switch module.

8. The vacuum switch module of claim 7, further comprising:

said moving contact is mounted to a moving annular contact support and said stationary contact is mounted to a stationary annular contact support.

9. The vacuum switch module of claim 7 wherein:

said operating rod is insulated from said vacuum envelope by a coaxial moving tubular insulator.

10. The vacuum switch module of claim 7 wherein:

said drive rod and said operating rod enable at least two similar vacuum devices to be operated together.

11. The vacuum switch module of claim 7 wherein:

said adjustable mechanism includes a housing, an adjustable spring retainer, a spring and said drive rod, said spring is retained between said housing and said adjustable spring retainer, rotation of said adjustable spring retainer relative to said housing changes a position between said moving contact and said stationary contact.

12. The vacuum switch module of claim 7 wherein:

said moving contact and said stationary contact are butt contacts.

13. The vacuum switch module of claim 7 wherein said moving contact and said stationary contact are transverse magnetic field contacts.

14. The vacuum switch module of claim 7 wherein said moving contact and said stationary contact are axial magnetic field contacts.

15. A vacuum interrupter comprising:

at least two vacuum enclosures; and at least two modules connected in series, each one of said at least two modules being retained in one of said at least two vacuum enclosures, each one of said at least two modules includes a contact system, an adjuster and an operating rod, said contact system includes a moving contact and a stationary contact, said adjuster includes an adjustment mechanism and a drive rod, said adjuster is mounted to said moving contact, said adjuster changes a distance between said moving contact and said stationary contact, said operating rod having a first end and a second end, said first end of said operating rod is secured to the other end of said drive rod, said operating rod is retained adjacent said contact system, said operating rod includes a capacitor resistor network.

16. The vacuum interrupter of claim 15 wherein:

two adjacent modules of said at least two modules are connected in series with a turnbuckle adapter, said turnbuckle adapter adjusts a distance between said two adjacent modules.

17. The vacuum interrupter of claim 15 wherein:

at least two of said at least two modules are connected in series to form a multiple break switch.

18. The vacuum interrupter of claim 15 wherein:

at least two of said at least two modules are connected in series to form one of a single break transfer switch and a multiple break transfer switch.

19. The vacuum interrupter of claim 15 wherein:

at least two of said at least two modules are connected in series to form one of a single break capacitor switch with pre-insertion contacts and a multiple break capacitor switch with pre-insertion contacts.

* * * * *